US010027009B2

(12) United States Patent
Baba et al.

(10) Patent No.: US 10,027,009 B2
(45) Date of Patent: Jul. 17, 2018

(54) HIGH-FREQUENCY SIGNAL TRANSMISSION LINE

(71) Applicant: Murata Manufacturing Co., Ltd., Nagaokakyo-shi, Kyoto-fu (JP)

(72) Inventors: Takahiro Baba, Nagaokakyo (JP); Kuniaki Yosui, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/356,739

(22) Filed: Nov. 21, 2016

(65) Prior Publication Data

US 2017/0069945 A1 Mar. 9, 2017

Related U.S. Application Data

(63) Continuation of application No. PCT/JP2015/068285, filed on Jun. 25, 2015.

(30) Foreign Application Priority Data

Jul. 18, 2014 (JP) ..... 2014-147791
Aug. 5, 2014 (JP) ..... 2014-159389

(51) Int. Cl.
*H01P 3/08* (2006.01)
*H01P 1/02* (2006.01)

(52) U.S. Cl.
CPC ..... *H01P 3/08* (2013.01); *H01P 1/02* (2013.01); *H01P 3/085* (2013.01)

(58) Field of Classification Search
CPC .. H01P 3/08; H01P 3/081; H01P 3/082; H01P 3/085; H01P 3/087
USPC ..... 333/1, 4, 5, 238, 246
See application file for complete search history.

(56) References Cited

U.S. PATENT DOCUMENTS

2012/0274423 A1 11/2012 Kato
2014/0176266 A1* 6/2014 Kato ..... H01P 3/08 333/238
2015/0054600 A1 2/2015 Sasaki et al.

FOREIGN PATENT DOCUMENTS

JP 1-160702 U 11/1989
WO 2012/073591 A1 6/2012
WO 2014/084011 A1 6/2014

OTHER PUBLICATIONS

Official Communication issued in International Patent Application No. PCT/JP2015/068285, dated Sep. 1, 2015.

* cited by examiner

*Primary Examiner* — Stephen E Jones
(74) *Attorney, Agent, or Firm* — Keating & Bennett, LLP

(57) ABSTRACT

A high-frequency signal transmission line includes a dielectric body, a signal conductor, and a ground conductor. The dielectric body extends along a high-frequency signal transmission direction. The signal conductor is in the dielectric body and extends along the high-frequency signal transmission direction. The ground conductor is in the dielectric body and is electromagnetically coupled to the signal conductor. The dielectric body includes, along the high-frequency signal transmission direction, a plurality of straight portions and a curved portion connecting the plurality of straight portions. In the curved portion, the signal conductor is located at a position on an inner side of a curve relative to a center position in a width direction of the dielectric body.

19 Claims, 12 Drawing Sheets

HIGH-FREQUENCY SIGNAL TRANSMISSION LINE

CROSS REFERENCE TO RELATED APPLICATIONS

This application claims the benefit of priority to Japanese Patent Application No. 2014-147791 filed Jul. 18, 2014, Japanese Patent Application No. 2014-159389 filed Aug. 5, 2014, and is a Continuation Application of PCT Application No. PCT/JP2015/068285 filed on Jun. 25, 2015. The entire contents of each application are hereby incorporated herein by reference.

BACKGROUND OF THE INVENTION

1. Field of the Invention

The present invention relates to a flat-film-shaped high-frequency signal transmission line.

2. Description of the Related Art

Various high-frequency signal transmission lines have been developed. For example, the high-frequency signal transmission line described in International Publication No. 2012/073591 is a flat-film-shaped high-frequency signal transmission line. The high-frequency signal transmission line described in International Publication No. 2012/073591 includes a flat-film-shaped and long-length dielectric body.

The dielectric body includes a linear signal conductor, first ground conductor, and second ground conductor. The signal conductor is located at a position in the thickness direction of the dielectric body. The first and second ground conductors sandwich the signal conductor in the thickness direction of the dielectric body. With this configuration, the signal conductor and the first and second ground conductors form a strip line.

At both ends in the long-length direction of the dielectric body, that is, at both ends in the long-length direction of the high-frequency signal transmission line, connectors are provided as external connection terminals for connecting the signal conductor and the first and second ground conductors to an external circuit.

The high-frequency signal transmission line described in International Publication No. 2012/073591 simply linearly extends and thus the positional relationship between the connectors at both ends in the long-length direction is fixed. In other words, it is impossible to change the distance between the connectors along the long-length direction of the high-frequency signal transmission line and the distance between the connectors along the width direction perpendicular or substantially perpendicular to the long-length direction and thickness direction.

To change the positional relationship between the connectors, a curved portion may be provided at a position of the dielectric body and a plurality of straight portions may be connected by the curved portion. In this case, deformation of the curved portion causes a change in the positional relationship between the connectors at both ends.

However, with this configuration including a curved portion, the curved portion may rupture more easily than the other portion due to a stress applied to the curved portion when the curved portion is deformed. Furthermore, the existence of the curved portion may degrade the transmission characteristic of a high-frequency signal.

SUMMARY OF THE INVENTION

Accordingly, preferred embodiments of the present invention is to provide a high-frequency signal transmission line that has an excellent high-frequency signal transmission characteristic and that is resistant to rupture.

A high-frequency signal transmission line according to a preferred embodiment of the present invention includes a dielectric body, a signal conductor, and a ground conductor. The dielectric body extends along a high-frequency signal transmission direction. The signal conductor is in the dielectric body and extends along the high-frequency signal transmission direction. The ground conductor is in the dielectric body and is electromagnetically coupled to the signal conductor.

The dielectric body includes, along the high-frequency signal transmission direction, a plurality of straight portions and a curved portion connecting the plurality of straight portions. In the curved portion, the signal conductor is located at a position on an inner side of a curve relative to a center position in a width direction of the dielectric body.

With this configuration, the strength on the inner side of the curved portion against an external stress is enhanced. Thus, in the case of deforming the dielectric body, rupture on the inner side of the curved portion mainly applied with the stress is significantly reduced or prevented. Furthermore, the signal conductor is offset toward the inner side of the curved portion to provide a shortcut, and thus the length of the signal conductor is decreased and transmission loss is significantly reduced or prevented.

Preferably, in the plurality of straight portions, the signal conductor may be located at the center or substantially at the center position in the width direction of the dielectric body. In this configuration, a specific configuration of the straight portions is illustrated.

Preferably, the signal conductor may have a larger width in the curved portion than in the plurality of straight portions.

With this configuration, the strength is further enhanced. Since the signal conductor is offset from the center position in the width direction, a decrease in capacitive coupling with the ground conductor is significantly reduced or prevented, and a change in impedance is significantly reduced or prevented.

Preferably, the ground conductor may include a first ground conductor and a second ground conductor. The signal conductor may be located between the first ground conductor and the second ground conductor along a thickness direction of the dielectric body.

With this configuration, the signal conductor and the first and second ground conductors define a strip line, and radiation of noise of a high-frequency signal to the outside and an influence of external noise on a high-frequency signal are significantly reduced or prevented. In the curved portion, the strength is further enhanced.

Preferably, in the plurality of straight portions of the dielectric body, at least one of a center position in a width direction of the first ground conductor and a center position in a width direction of the second ground conductor may be different from a center position in a width direction of the signal conductor in the width direction of the dielectric body.

With this configuration, in the straight portions, capacitive coupling between the signal conductor and the first and second ground conductors is able to be decreased. Accordingly, the width of the signal conductor is able to be increased and transmission loss is able to be significantly reduced or prevented.

Preferably, in the curved portion of the dielectric body, at an end portion connected to the plurality of straight portions, the center position in the width direction of the first ground conductor may be at a position on the inner side of the curve relative to the center position in the width direction of the signal conductor and the center position in the width direction of the second ground conductor. The center position in the width direction of the signal conductor and the center position in the width direction of the second ground conductor may shift toward the inner side of the curve, in a direction toward a center position in an extending direction of the curved portion.

With this configuration, a difference (variation) in capacitive coupling between positions along the extending direction of the curved portion is significantly reduced or prevented, and transmission loss is significantly reduced or prevented.

Preferably, in the curved portion, in a region where the center position in the width direction of the signal conductor is on an outer side of the curve relative to the center position in the width direction of the first ground conductor or is at a position identical to the center position in the width direction of the first ground conductor, the center position in the width direction of the second ground conductor may not shift whereas the center position in the width direction of the signal conductor may shift toward the inner side of the curve, in the direction toward the center position in the extending direction of the curved portion. In a region where the center position in the width direction of the signal conductor is on the inner side of the curve relative to the center position in the width direction of the first ground conductor, the center position in the width direction of the second ground conductor may shift toward the inner side of the curve with a shift amount larger than a shift amount of the center position in the width direction of the signal conductor.

With this configuration, a difference (variation) in capacitive coupling between positions along the extending direction of the curved portion is further significantly reduced or prevented, and transmission loss is significantly reduced or prevented.

According to a preferred embodiment of the present invention, a high-frequency signal transmission line that has an excellent transmission characteristic and that is highly reliable is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
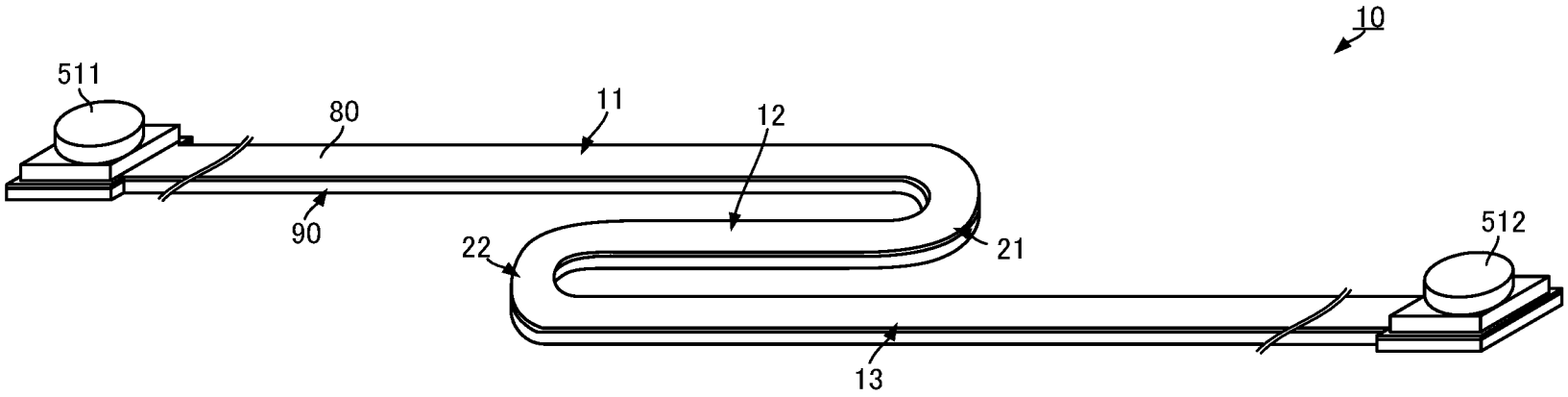
FIG. 1 is a perspective view of the appearance of a high-frequency signal transmission line according to a first preferred embodiment of the present invention.

A high-frequency signal transmission line according to a first preferred embodiment of the present invention will be described with reference to the drawings. FIG. 1 is a perspective view of the appearance of a high-frequency signal transmission line 10 according to the first preferred embodiment of the present invention.

The high-frequency signal transmission line 10 includes a flat-plate-shaped and long-length dielectric body 90. The dielectric body 90 includes a plurality of dielectric films stacked in the thickness direction. The dielectric films are made of, for example, a flexible resin material. Specifically, the dielectric films are preferably made of a resin material mainly containing liquid crystal polymer.

The dielectric body 90 includes straight portions 11, 12, and 13 and curved portions 21 and 22. The straight portions 11, 12, and 13 are located such that the directions in which they extend are parallel or substantially parallel to one another. The straight portions 11, 12, and 13 are located at intervals along the direction perpendicular or substantially perpendicular to the extending direction and the thickness direction. In other words, the straight portions 11, 12, and 13 are located at intervals along the direction parallel or substantially parallel to the width direction of the straight portions 11, 12, and 13.

The straight portions 11 and 12 are connected to each other with the curved portion 21 interposed therebetween, and the straight portions 12 and 13 are connected to each other with the curved portion 22 interposed therebetween. The curved portions 21 and 22 connect the straight portions 11, 12, and 13 such that the straight portions 11, 12, and 13 are on the same plane when no external force is applied thereto.

Preferably, the straight portions 11, 12, and 13 and the curved portions 21 and 22 are integrated together rather than being individually formed and connected to one another.

Linear signal conductors (not illustrated in FIG. 1) are located at a position in the thickness direction of the dielectric body 90. First ground conductors (not illustrated in FIG. 1) are located near one end in the thickness direction of the dielectric body 90. Second ground conductors (not illustrated in FIG. 1) are located near the other end in the thickness direction of the dielectric body 90. Accordingly, the dielectric body 90 includes a strip line defined by the signal conductors, the first ground conductors, and the second ground conductors.

The signal conductors located in the individual straight portions 11, 12, and 13 and the individual curved portions 21 and 22 are connected to one another. More specifically, the signal conductor in the straight portion 11 is connected to the signal conductor in the curved portion 21, and the signal conductor in the curved portion 21 is connected to the signal conductor in the straight portion 12. The signal conductor in the straight portion 12 is connected to the signal conductor in the curved portion 22, and the signal conductor in the curved portion 22 is connected to the signal conductor in the straight portion 13. The first ground conductors located in the individual straight portions 11, 12, and 13 and the individual curved portions 21 and 22 are connected to one another. More specifically, the first ground conductor in the straight portion 11 is connected to the first ground conductor in the curved portion 21, and the first ground conductor in the curved portion 21 is connected to the first ground conductor in the straight portion 12. The first ground conductor in the straight portion 12 is connected to the first ground conductor in the curved portion 22, and the first ground conductor in the curved portion 22 is connected to the first ground conductor in the straight portion 13. The second ground conductors located in the individual straight portions 11, 12, and 13 and the individual curved portions 21 and 22 are connected to one another. More specifically, the second ground conductor in the straight portion 11 is connected to the second ground conductor in the curved portion 21, and the second ground conductor in the curved portion 21 is connected to the second ground conductor in the straight portion 12. The second ground conductor in the straight portion 12 is connected to the second ground conductor in the curved portion 22, and the second ground conductor in the curved portion 22 is connected to the second ground conductor in the straight portion 13.

A connector 511, which defines and functions as an external connection terminal, is located at one end portion (an end portion on the straight portion 11 side) in the long-length direction of the dielectric body 90. A connector 512, which defines and functions as an external connection terminal, is located at the other end portion (an end portion on the straight portion 13 side) in the long-length direction of the dielectric body 90. The connectors 511 and 512 are connected to the signal conductors and the first and second ground conductors although not illustrated.

An insulating resist 80 is located on a surface on which the connectors 511 and 512 are located of the dielectric body 90. The insulating resist 80 may be omitted if any of the ground conductors is not exposed on a front surface of the dielectric body 90.

Next, specific structures of the straight portions 11 and 12 and the curved portion 21 will be described with reference to FIGS. 2A to 2C. The straight portion 13 has a structure similar to that of the straight portions 11 and 12. The curved portion 22 has a structure similar to that of the curved portion 21.

Figure 2A:
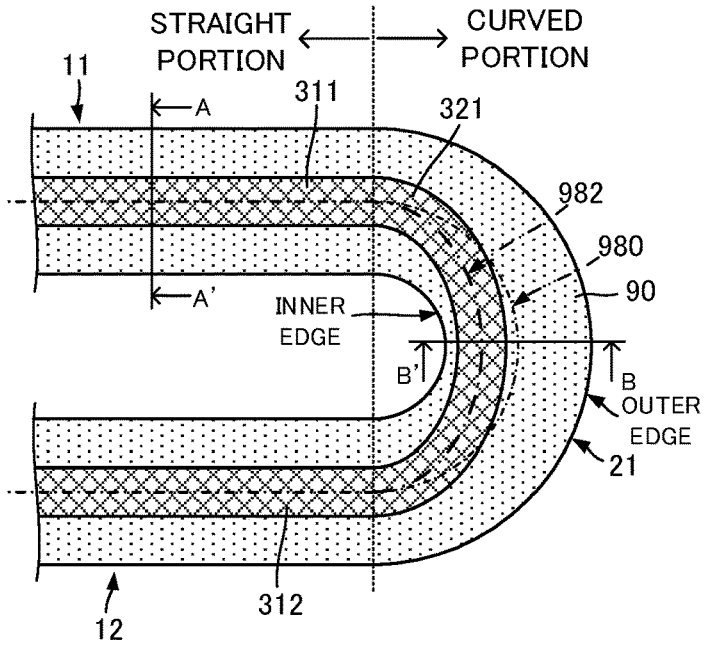
FIGS. 2A to 2C include a plan view and cross-sectional views illustrating the configurations of conductors in the high-frequency signal transmission line according to the first preferred embodiment of the present invention.

FIG. 2A is a plan view illustrating the configurations of conductors in the high-frequency signal transmission line 10 according to the first preferred embodiment of the present invention. In FIG. 2A, the illustration of the first and second ground conductors is omitted to clearly illustrate the shapes of the signal conductors.

Figure 2B:
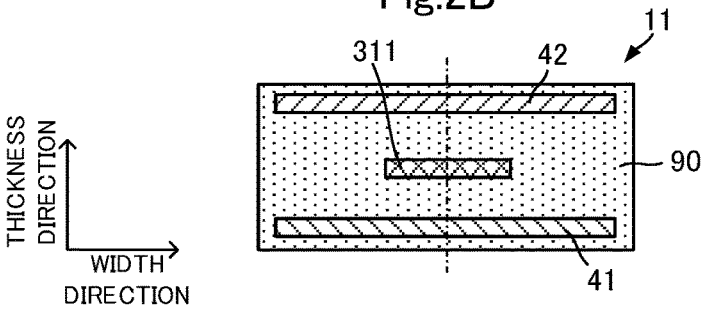

FIG. 2B is a cross-sectional view taken along line A-A' in FIG. 2A of the high-frequency signal transmission line 10 according to the first preferred embodiment of the present invention. FIG. 2C is a cross-sectional view taken along line B-B' in FIG. 2A of the high-frequency signal transmission line 10 according to the first preferred embodiment of the present invention.

As illustrated in FIG. 2A, the straight portions 11 and 12 are located such that the directions in which they extend are parallel or substantially parallel to each other. The straight portions 11 and 12 are located at an interval along the direction parallel to the width direction. The curved portion 21 preferably is curved 180 degrees and is flat-film-shaped when viewed in plan, for example. With the curved portion 21 having such a shape, an end portion of the straight portion 11 and an end portion of the straight portion 12 located along the direction parallel or substantially parallel to the width direction of the straight portions 11 and 12 are connected to each other with the curved portion 21 interposed therebetween.

As illustrated in FIG. 2B, in the straight portion 11, a signal conductor 311 is located at or substantially at the center in the thickness direction of the dielectric body 90 and at substantially the center in the width direction of the dielectric body 90. In the straight portion 11, a first ground conductor 41 is located near one end surface in the thickness direction of the dielectric body 90. In the straight portion 11, a second ground conductor 42 is located near the other end surface in the thickness direction of the dielectric body 90. The first ground conductor 41 and the second ground conductor 42 extend over substantially the entire surface of the dielectric body 90 when viewed in plan. The signal conductor 311 has a width smaller than that of the dielectric body 90 and the first and second ground conductors 41 and 42. The width of the signal conductor 311 is set on the basis of the material of the dielectric body 90, the distance from the first and second ground conductors 41 and 42, and the impedance of the high-frequency signal transmission line 10.

The straight portion 12 preferably has the same configuration as that of the straight portion 11 except that the straight portion 12 includes a signal conductor 312 instead of the signal conductor 311.

Figure 2C:
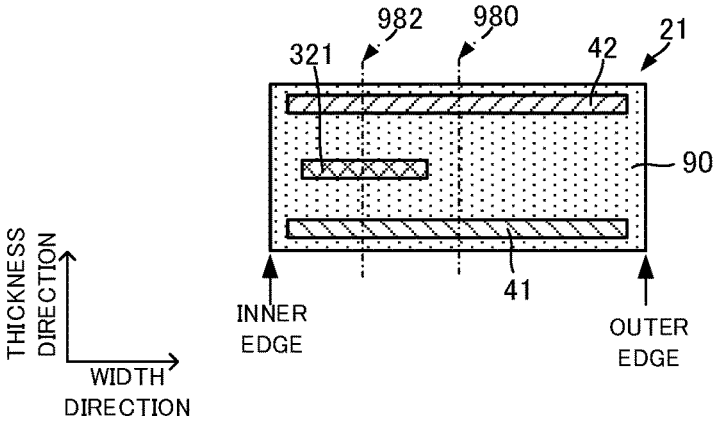

As illustrated in FIGS. 2A and 2C, in the curved portion 21, a signal conductor 321 is located at or substantially at the center in the thickness direction of the dielectric body 90. The signal conductor 321 has the same or substantially the same width as that of the signal conductors 311 and 312 in the straight portions 11 and 12. The signal conductor 321 is located at the same position as that of the signal conductors 311 and 312 in the straight portions 11 and 12 in the thickness direction of the dielectric body 90. The signal conductor 321 is integrated with the signal conductors 311 and 312.

The signal conductor 321 is offset toward an inner edge of the curved portion 21 from the center position in the width direction of the curved portion 21 in the dielectric body 90. The signal conductor 321 is the closest to the inner edge at the center in the extending direction of the curved portion 21. For example, the signal conductor 321 is oval shaped such that the direction parallel or substantially parallel to the extending direction of the straight portions 11 and 12 is a short-axis direction when viewed in plan. Preferably, a center position 982 in the width direction of the signal conductor 321 is on the inner edge side relative to a center position 980 in the width direction of the dielectric body 90 at any position in the extending direction of the signal conductor 321.

In the curved portion 21, the first ground conductor 41 is located near one end surface in the thickness direction of the dielectric body 90. In the curved portion 21, the second ground conductor 42 is located near the other end surface in the thickness direction of the dielectric body 90. The first ground conductor 41 and the second ground conductor 42 extend over substantially the entire surface of the dielectric body 90 when viewed in plan.

Figure 3A:
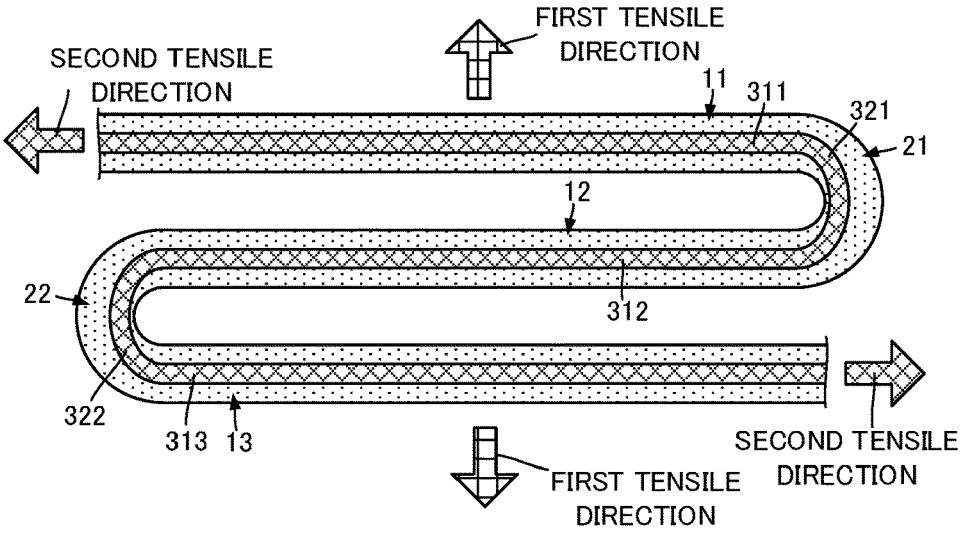
FIGS. 3A to 3C are diagrams for describing stress in a state where the high-frequency signal transmission line according to the first preferred embodiment of the present invention is tensile-deformed.
Figure 3B:
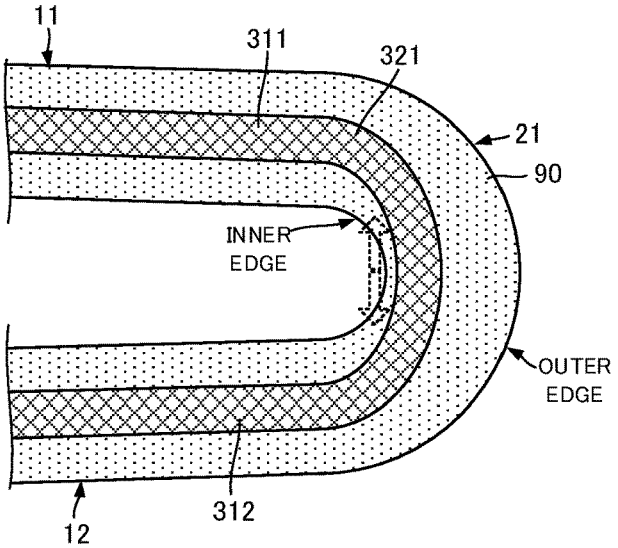
Figure 3C:
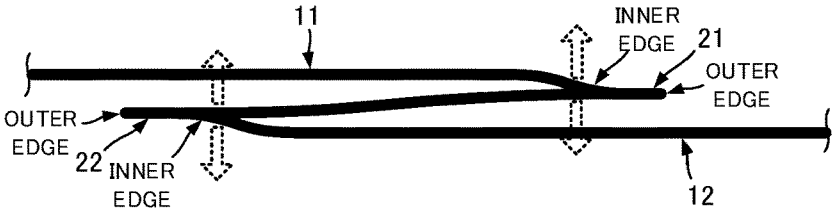

FIGS. 3A to 3C are diagrams for describing stress in a state where the high-frequency signal transmission line 10 according to the first preferred embodiment of the present invention is tensile-deformed. FIG. 3A is a plan view illustrating tensile directions for the high-frequency signal transmission line 10. FIG. 3B is a diagram illustrating stress in a state where the high-frequency signal transmission line 10 according to the first preferred embodiment is tensile-deformed in the first tensile direction illustrated in FIG. 3A. FIG. 3C is a diagram illustrating a state where the high-frequency signal transmission line 10 is tensile-deformed in the second tensile direction illustrated in FIG. 3A.

As illustrated in FIG. 3A, the dielectric body 90 (the high-frequency signal transmission line 10) is pulled in the first tensile direction, which is a direction parallel to the width direction of the straight portions 11, 12, and 13. In this case, the dielectric body 90 is deformed such that the distance between the straight portions 11 and 12 connected to the curved portion 21 increases, as illustrated in FIG. 3B. When such deformation occurs, a tensile stress in the direction parallel or substantially parallel to the width direction of the straight portions 11 and 12 is applied to the inner edge of the curved portion 21.

In the high-frequency signal transmission line 10 according to the first preferred embodiment, the signal conductor 321, which is more resistant to a tensile stress than the dielectric body 90, is located near the inner edge of the curved portion 21. Thus, even if a tensile stress is applied to the inner edge of the curved portion 21, the dielectric body 90 including the signal conductor 321 at such a location is more resistant to rupture than a configuration in which a signal conductor is located at the center in the width direction of a dielectric body.

Although not illustrated, the curved portion 22 is also resistant to rupture, similarly to the curved portion 21.

As illustrated in FIG. 3A, the dielectric body 90 (the high-frequency signal transmission line 10) is pulled in the second tensile direction, which is a direction parallel to the long-length direction of the straight portions 11, 12, and 13. In this case, the straight portions 11, 12, and 13 and the curved portions 21 and 22 are deformed such that the straight portions 11, 12, and 13 are located at different positions in the thickness direction, as illustrated in FIG. 3C. When such deformation occurs, a tensile stress in the direction parallel to the thickness direction of the dielectric body 90 is applied to the inner edges of the curved portions 21 and 22.

In the high-frequency signal transmission line 10 according to the first preferred embodiment, a signal conductor that is more resistant to a tensile stress than the dielectric body 90 is located near the inner edges of the curved portions 21 and 22. Thus, even if a tensile stress is applied to the inner edges of the curved portions 21 and 22, the dielectric body 90 including a signal conductor at such a location is more resistant to rupture than a configuration in which a signal conductor is located at the center in the width direction of a dielectric body.

As described above, the high-frequency signal transmission line 10 according to the first preferred embodiment is less likely to rupture even if the high-frequency signal transmission line 10 is pulled to mount it on an external circuit or the like. Thus, the high-frequency signal transmission line 10 having high reliability is provided.

In the configuration of the high-frequency signal transmission line 10 according to the first preferred embodiment, the signal conductors are offset toward the inner edges of the curved portions 21 and 22 to make a shortcut of a signal transmission path. Accordingly, the signal transmission distance is decreased, transmission loss is decreased, and the high-frequency signal transmission line 10 having an excellent transmission characteristic is obtained.

In a case where a high-frequency signal transmission line includes a plurality of curved portions, it is sufficient, in order to at least obtain the above-described effect, that the above-described configuration in which a signal conductor is offset toward an inner edge of a curved portion is used in one of the curved portions.

The above-described high-frequency signal transmission line 10 includes a strip line provided by sandwiching a signal conductor between first and second ground conductors. However, the above-described configuration in which the signal conductor is offset toward the inner edge of the curved portion may be applied to a micro-strip line that does not include a second ground conductor, so as to obtain a similar effect. Note that, with the configuration according to the first preferred embodiment, two ground conductors including the first and second ground conductors are located as well as the signal conductor near the inner edge, and thus a more reliable high-frequency signal transmission line is provided. Furthermore, with use of the strip line, unnecessary radiation of a high-frequency signal that is transmitted through the high-frequency signal transmission line 10 is significantly reduced or prevented. In addition, superposition of external noise on a high-frequency signal that is transmitted through the high-frequency signal transmission line 10 is significantly reduced or prevented. Accordingly, a high-frequency signal transmission line having a further excellent transmission characteristic is obtained.

Figure 4:
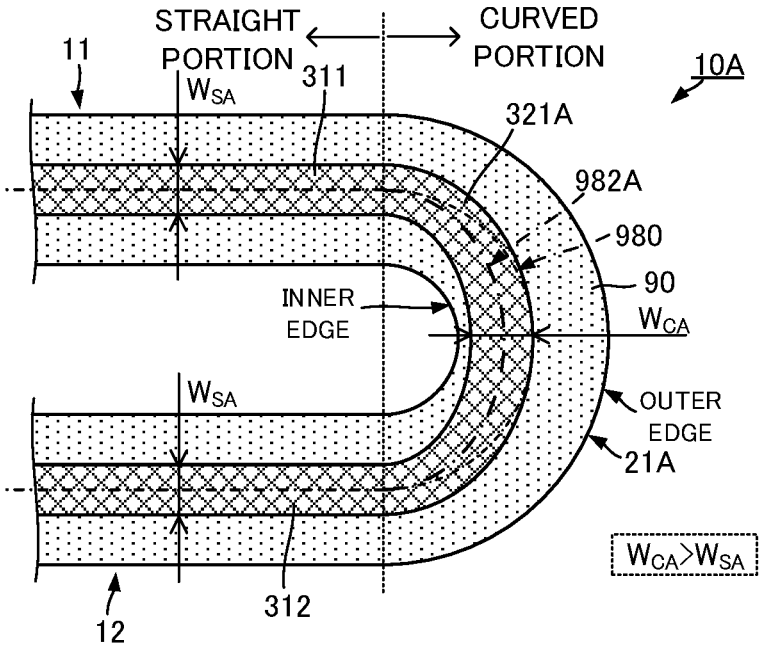
FIG. 4 is a plan view illustrating the configurations of conductors in a region including a curved portion in a high-frequency signal transmission line according to a second preferred embodiment of the present invention.

Next, a high-frequency signal transmission line according to a second preferred embodiment of the present invention will be described with reference to the drawings. FIG. 4 is a plan view illustrating the configurations of conductors in a region including a curved portion in a high-frequency signal transmission line 10A according to the second preferred embodiment of the present invention. In FIG. 4, the illustration of the first and second ground conductors is omitted to clearly illustrate the shapes of the signal conductors.

The high-frequency signal transmission line 10A according to the second preferred embodiment is different from the high-frequency signal transmission line 10 according to the first preferred embodiment in the configuration of the signal conductor in the curved portion. The configuration of the other portions is the same as that of the high-frequency signal transmission line 10 according to the first preferred embodiment.

A curved portion 21A of the high-frequency signal transmission line 10A includes a signal conductor 321A. The signal conductor 321A is located at or substantially at the center in the thickness direction of the dielectric body 90. The signal conductor 321A is offset toward the inner edge of the curved portion 21A from the center position in the width direction of the dielectric body 90. One end of the signal conductor 321A is connected to the signal conductor 311 of the straight portion 11, and the other end of the signal conductor 321A is connected to the signal conductor 312 of the straight portion 12.

The signal conductor 321A has a width $W_{CA}$, which is larger than a width $W_{SA}$ of the signal conductors 311 and 312. Preferably, the width $W_{CA}$ of the signal conductor 321A gradually increases toward the center in the extending direction of the curved portion 21A and is the largest at the center in the extending direction of the curved portion 21A. Alternatively, the width of the signal conductor 321A may increase step by step.

With this configuration, even if the center position in the width direction of the signal conductor 321A is offset from the center positions in the width direction of the first and second ground conductors, a decrease in capacitive coupling between the signal conductor 321A and the first and second ground conductors is significantly reduced or prevented. Accordingly, a difference in characteristic impedance between the straight portions 11 and 12 and the curved portion 21A is significantly reduced or prevented, and transmission loss is significantly reduced or prevented.

Furthermore, the proportion of the conductor located on the inner edge side of the curved portion 21A applied with a tensile stress increases. Accordingly, the high-frequency signal transmission line 10A that is more resistant to rupture and that is highly reliable is obtained.

Figure 5:
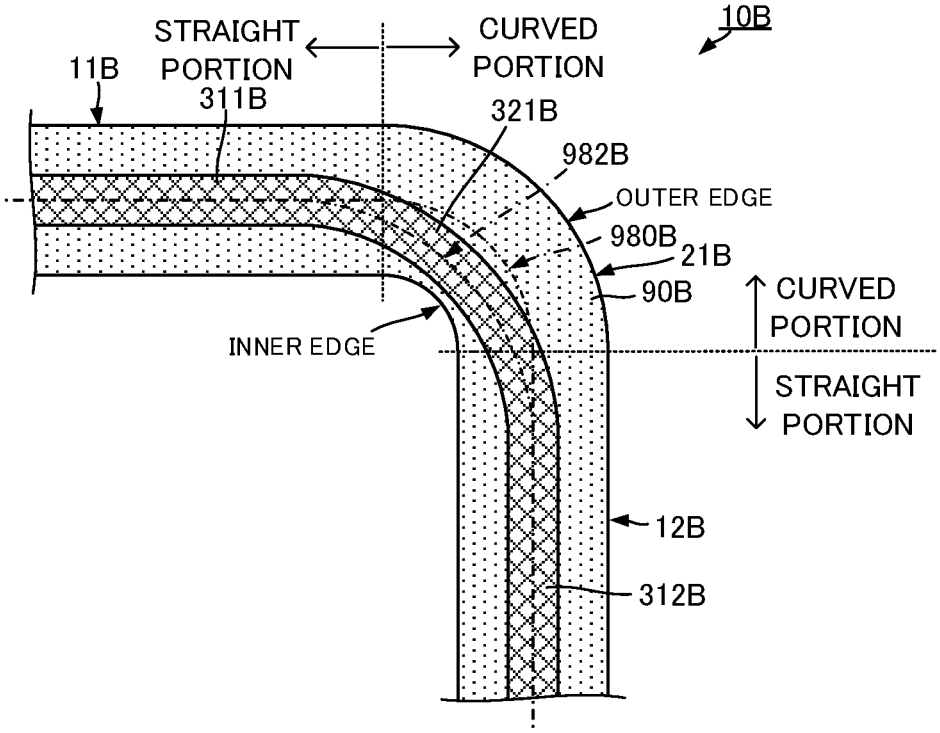
FIG. 5 is a plan view illustrating the configurations of conductors in a region including a curved portion in a high-frequency signal transmission line according to a third preferred embodiment of the present invention.

Next, a high-frequency signal transmission line according to a third preferred embodiment of the present invention will be described with reference to the drawings. FIG. 5 is a plan view illustrating the configurations of conductors in a region including a curved portion in a high-frequency signal transmission line 10B according to the third preferred embodiment of the present invention. In FIG. 5, the illustration of the first and second ground conductors is omitted to clearly illustrate the shapes of the signal conductors.

The basic configuration of the high-frequency signal transmission line 10B according to the third preferred embodiment is the same as that of the high-frequency signal transmission line 10 according to the first preferred embodiment. That is, the high-frequency signal transmission line 10B according to the third preferred embodiment is, similarly to the high-frequency signal transmission line 10 according to the first preferred embodiment, a transmission line defined by a strip line including straight portions and a curved portion along a high-frequency signal transmission direction.

A dielectric body 90B of the high-frequency signal transmission line 10B includes straight portions 11B and 12B and a curved portion 21B.

The angle defined by the extending direction (long-length direction) of the straight portion 11B and the extending direction (long-length direction) of the straight portion 12B preferably is about 90 degrees. The angle defined by these directions is not limited to about 90 degrees. The configuration according to the third preferred embodiment is applicable when the straight portions 11B and 12B are not parallel to each other. The straight portion 11B includes a signal conductor 311B. The signal conductor 311B extends along the extending direction of the straight portion 11B. The straight portion 12B includes a signal conductor 312B. The signal conductor 312B extends along the extending direction of the straight portion 12B.

The curved portion 21B is curved 90 degrees when viewed in plan and connects the straight portions 11B and 12B to each other. The curved portion 21B includes a signal conductor 321B. The signal conductor 321B is offset toward the inner edge of the curved portion 21B from the center position in the width direction of the curved portion 21B in the dielectric body 90B. The signal conductor 321B is the closest to the inner edge at the center in the extending direction of the curved portion 21B. For example, the signal conductor 321B has an arc shape with a radius of curvature larger than that of the curved portion 21B when viewed in plan. Preferably, a center position 982B in the width direction of the signal conductor 321B is on the inner edge side relative to a center position 980B in the width direction of the curved portion 21B of the dielectric body 90B at any position in the extending direction of the signal conductor 321B.

With this configuration, as in the above-described first preferred embodiment, the high-frequency signal transmission line 10B having an excellent transmission characteristic and high reliability is provided.

In the above-described preferred embodiments, high-frequency signal transmission lines having a strip line structure are illustrated as an example, but the high-frequency signal transmission lines may have a micro-strip line structure. That is, the second ground conductor may be omitted. Alternatively, the second ground conductor may partially include an opening portion where no conductor is provided. For example, a plurality of opening portions may be provided at intervals along the extending direction of the second ground conductor.

In the above-described preferred embodiments, the first and second ground conductors are provided inside dielectric layers, but one of the first and second ground conductors may be provided on a front surface of the dielectric layers, or the first and second ground conductors may be provided on front surfaces facing each other of the dielectric layers.

Figure 6A:
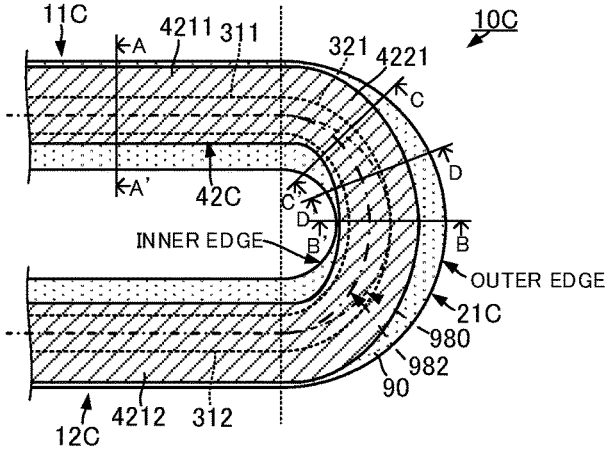
FIGS. 6A to 6C are plan views illustrating the configurations of conductors in a high-frequency signal transmission line according to a fourth preferred embodiment of the present invention.
Figure 6B:
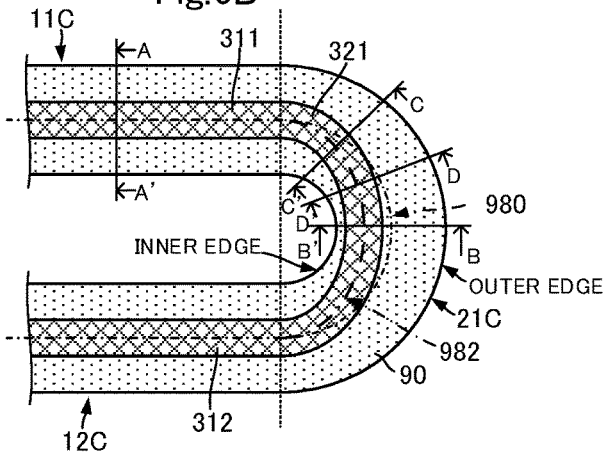
Figure 6C:
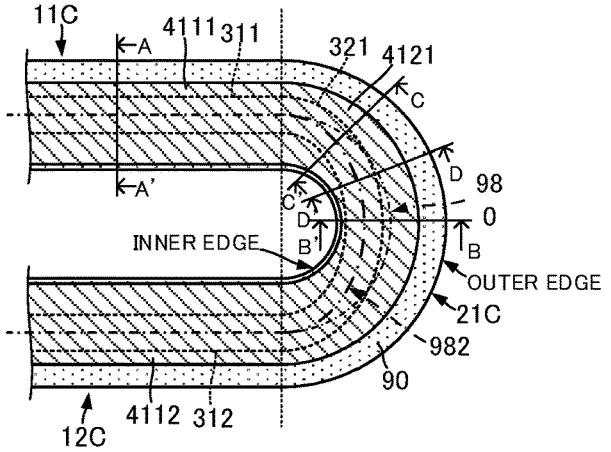
Figure 7A:
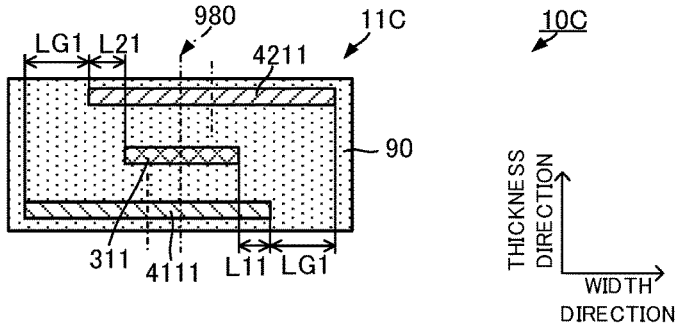
FIGS. 7A to 7D are cross-sectional views illustrating the configurations of the conductors in the high-frequency signal transmission line according to the fourth preferred embodiment of the present invention.

Next, a high-frequency signal transmission line according to a fourth preferred embodiment of the present invention will be described with reference to the drawings. FIGS. 6A to 6C are plan views illustrating the configurations of conductors in a high-frequency signal transmission line 10C according to the fourth preferred embodiment of the present invention. FIG. 6A is a plan view illustrating the configurations of second ground conductors, FIG. 6B is a plan view illustrating the configurations of signal conductors, and FIG. 6C is a plan view illustrating the configurations of first ground conductors. FIGS. 7A to 7D are cross-sectional views illustrating the configurations of the conductors in the high-frequency signal transmission line 10C according to the fourth preferred embodiment of the present invention. FIG. 7A is a cross-sectional view taken along line A-A' in FIGS. 6A to 6C, FIG. 7B is a cross-sectional view taken along line C-C' in FIGS. 6A to 6C, FIG. 7C is a cross-sectional view taken along line D-D' in FIGS. 6A to 6C, and FIG. 7D is a cross-sectional view taken along line B-B' in FIGS. 6A to 6C.

The high-frequency signal transmission line 10C according to the fourth preferred embodiment is different from the high-frequency signal transmission line 10 according to the first preferred embodiment in the positional relationship between signal conductors and first and second ground conductors. The shapes or basic external shapes of signal conductors in the straight portion and curved portion in the high-frequency signal transmission line 10C are the same or substantially the same as those in the high-frequency signal transmission line 10 according to the first preferred embodiment.

As illustrated in FIG. 6A, a second ground conductor 4211 is located in a straight portion 11C, a second ground conductor 4221 is located in a curved portion 21C, and a second ground conductor 4212 is located in a straight portion 12C. The second ground conductors 4211, 4221, and 4212 are integrated together. The second ground conductors 4211, 4221, and 4212 are located near one end surface in the thickness direction of the dielectric body 90. The second ground conductors 4211, 4221, and 4212 have a width shorter than the width of the dielectric body 90 by a certain length. In other words, the second ground conductors 4211, 4221, and 4212 do not extend over the entire width of the dielectric body 90.

As illustrated in FIG. 6B, the signal conductor 311 is located in the straight portion 11C, the signal conductor 321 is located in the curved portion 21C, and the signal conductor 312 is located in the straight portion 12C. The signal conductors 311, 321, and 312 are integrated together. The signal conductors 311, 321, and 312 are located at or substantially at the center in the thickness direction of the dielectric body 90.

As illustrated in FIG. 6C, a first ground conductor 4111 is located in the straight portion 11C, a first ground conductor 4121 is located in the curved portion 21C, and a first ground conductor 4112 is located in the straight portion 12C. The first ground conductors 4111, 4121, and 4112 are integrated together. The first ground conductors 4111, 4121, and 4112 are located near one end surface in the thickness direction of the dielectric body 90.

As described above, the high-frequency signal transmission line 10C according to the fourth preferred embodiment has a so-called strip line structure in which a signal conductor is located at a certain position between a first ground conductor and a second ground conductor in the thickness direction of the dielectric body 90.

Next, specific configurations of the signal conductors and the first and second ground conductors in the straight portions 11C and 12C and the curved portion 21C will be described.

As illustrated in FIGS. 6B and 7A, in the straight portion 11C, the signal conductor 311 is located at or substantially at the center in the width direction of the dielectric body 90. Also, in the straight portion 12C, the signal conductor 312 is located at or substantially at the center in the width direction of the dielectric body 90.

As illustrated in FIGS. 6B, 7B, 7C, and 7D, in the curved portion 21C, the signal conductor 321 is offset toward the inner edge of the curved portion 21C from the center position in the width direction of the curved portion 21C in the dielectric body 90, as in the high-frequency signal transmission line 10 according to the first preferred embodiment. The signal conductor 321 is the closest to the inner edge at the center in the extending direction of the curved portion 21C.

In the straight portion 11C, as illustrated in FIGS. 6A and 7A, the second ground conductor 4211 faces substantially the entire principle surface of the signal conductor 311. Furthermore, one end in the width direction of the second ground conductor 4211 is close to one side surface (the side surface opposite to the side surface facing the straight portion 12C) of the dielectric body 90. The other end in the width direction of the second ground conductor 4211 is located at a certain distance from the other side surface (the side surface facing the straight portion 12C) of the dielectric body 90. The certain distance is longer than the distance between the one end in the width direction of the second ground conductor 4211 and the one side surface of the dielectric body 90. That is, at the position in the thickness direction where the second ground conductor 4211 is located, a region without a conductor (a region corresponding to a length substantially equal to LG1 in FIG. 7A) is provided near the other side surface. Furthermore, a portion of the second ground conductor 4211 that is on the side of the one side surface and that does not face the signal conductor 311 has a length (a length substantially equal to L11+LG1 in FIG. 7A) which is larger than the length (L21 in FIG. 7A) of a portion that is on the side of the other side surface and that does not face the signal conductor 311. In other words, the second ground conductor 4211 is located such that the entire second ground conductor 4211 shifts toward the one side surface of the dielectric body 90 in the width direction of the dielectric body 90. That is, the center position in the width direction of the second ground conductor 4211 is offset toward the one side surface of the dielectric body 90 from the center position 980 in the width direction of the dielectric body 90 and the center position in the width direction of the signal conductor 311.

In the straight portion 12C, as illustrated in FIG. 6A, the second ground conductor 4212 faces substantially the entire principle surface of the signal conductor 312. Furthermore, in at least the region connected to the curved portion 21C and the vicinity thereof in the straight portion 12C, one end in the width direction of the second ground conductor 4212 is close to one side surface (the side surface opposite to the side surface facing the straight portion 11C (the surface connected to the side surface at the outer edge of the curved portion 21C)) of the dielectric body 90. The other end in the width direction of the second ground conductor 4212 is located at a certain distance from the other side surface (the side surface facing the straight portion 11C (the surface connected to the side surface at the inner edge of the curved portion 21C)) of the dielectric body 90. The certain distance is longer than the distance between the one end in the width direction of the second ground conductor 4212 and the one side surface of the dielectric body 90. That is, at the position in the thickness direction where the second ground conductor 4212 is located, a region without a conductor is provided near the other side surface. Furthermore, a portion of the second ground conductor 4212 that is on the side of the one side surface and that does not face the signal conductor 312 has a length larger than the length of a portion that is on the side of the other side surface and that does not face the signal conductor 312. In other words, in at least the region connected to the curved portion 21C and the vicinity thereof in the straight portion 12C, the second ground conductor 4212 is located such that the entire second ground conductor 4212 shifts toward the one side surface of the dielectric body 90 in the width direction of the dielectric body 90. That is, the center position in the width direction of the second ground conductor 4212 is offset toward the one side surface of the dielectric body 90 from the center position 980 in the width direction of the dielectric body 90 and the center position in the width direction of the signal conductor 312.

In the curved portion 21C, as illustrated in FIGS. 6A, 7B, 7C, and 7D, the second ground conductor 4221 is offset toward the inner edge of the curved portion 21C from the center position in the width direction of the curved portion 21C in the dielectric body 90. The second ground conductor 4221 is the closest to the inner edge at the center in the extending direction of the curved portion 21C. The second ground conductor 4221 in the curved portion 21C has the same width as that of the second ground conductors 4211 and 4212 in the straight portions 11C and 12C.

The specific positional relationship between the second ground conductor 4221 and the signal conductor 321 in the curved portion 21C will be described below.

In the straight portion 11C, as illustrated in FIGS. 6C and 7A, the first ground conductor 4111 faces substantially the entire principle surface of the signal conductor 311. Furthermore, one end in the width direction of the first ground conductor 4111 is located at a certain distance from one side surface (the side surface opposite to the side surface (the other side surface) facing the straight portion 12C) of the dielectric body 90. The certain distance is longer than the distance between the other end in the width direction of the first ground conductor 4111 and the other side surface of the dielectric body 90. The other end in the width direction of the first ground conductor 4111 is close to the other side surface (the side surface facing the straight portion 12C) of the dielectric body 90. That is, at the position in the thickness direction where the first ground conductor 4111 is located, a region without a conductor (a region corresponding to a length substantially equal to LG1 in FIG. 7A) is provided near the one side surface. Furthermore, a portion of the first ground conductor 4111 that is on the side of the other side surface and that does not face the signal conductor 311 has a length (a length substantially equal to L21+LG1 in FIG. 7A) which is larger than the length (L11 in FIG. 7A) of a portion that is on the side of the one side surface and that does not face the signal conductor 311. In other words, the first ground conductor 4111 is located such that the entire first ground conductor 4111 shifts toward the other side surface of the dielectric body 90 in the width direction of the dielectric body 90. That is, the center position in the width direction of the first ground conductor 4111 is offset toward the other side surface of the dielectric body 90 from the center position 980 in the width direction of the dielectric body 90 and the center position in the width direction of the signal conductor 311.

In the straight portion 12C, as illustrated in FIG. 6C, the first ground conductor 4112 faces substantially the entire principle surface of the signal conductor 312. Furthermore, in at least the region connected to the curved portion 21C and the vicinity thereof in the straight portion 12C, one end in the width direction of the first ground conductor 4112 is located at a certain distance from the one side surface (the side surface opposite to the side surface (the other side surface) facing the straight portion 11C (the surface connected to the side surface at the outer edge of the curved portion 21C)) of the dielectric body 90. The certain distance is longer than the distance between the other end in the width direction of the first ground conductor 4112 and the other side surface of the dielectric body 90. The other end in the width direction of the first ground conductor 4112 is close to the other side surface (the side surface facing the straight portion 11C (the surface connected to the side surface at the inner edge of the curved portion 21C)) of the dielectric body 90. That is, at the position in the thickness direction where the first ground conductor 4112 is located, a region without a conductor is provided near the one side surface. Furthermore, a portion of the first ground conductor 4112 that is on the side of the other side surface and that does not face the signal conductor 312 has a length which is larger than the length of a portion that is on the side of the one side surface and that does not face the signal conductor 312. In other words, in at least the region connected to the curved portion 21C and the vicinity thereof in the straight portion 12C, the first ground conductor 4112 is located such that the entire first ground conductor 4112 shifts toward the other side surface of the dielectric body 90 in the width direction of the dielectric body 90. That is, the center position in the width direction of the first ground conductor 4112 is offset toward the other side surface of the dielectric body 90 from the center position 980 in the width direction of the dielectric body 90 and the center position in the width direction of the signal conductor 312.

In the curved portion 21C, as illustrated in FIGS. 6C, 7B, 7C, and 7D, the first ground conductor 4121 is located on the inner edge side of the curved portion 21C in the dielectric body 90. More specifically, in the curved portion 21C, the end portion on the inner edge side of the curved portion 21C in the width direction of the first ground conductor 4121 is close to the inner edge of the curved portion 21C. The end portion on the outer edge side in the width direction of the first ground conductor 4121 is spaced apart from the outer edge of the curved portion 21C. That is, at the position in the thickness direction where the first ground conductor 4121 is located, a region without a conductor is provided near the side surface on the outer edge side. In other words, in the curved portion 21C, the first ground conductor 4121 is located such that the entire first ground conductor 4121 shifts toward the side surface on the inner edge side of the dielectric body 90 in the width direction of the dielectric body 90. The first ground conductor 4121 in the curved portion 21C has the same width as that of the first ground conductors 4111 and 4112 in the straight portions 11C and 12C.

As described above, in each straight portion of the high-frequency signal transmission line 10C according to the fourth preferred embodiment, the first ground conductor and the second ground conductor shift in different directions (opposite directions) in the width direction of the dielectric body 90. With this configuration, the first ground conductor and the second ground conductor have the same width but their center positions in the width direction are different in the width direction of the dielectric body 90. Furthermore, the center position in the width direction of the first ground conductor and the center position in the width direction of the second ground conductor are different from the center position in the width direction of the signal conductor in the width direction of the dielectric body 90. Thus, each straight portion includes a portion where the first ground conductor and the second ground conductor do not face each other intentionally in the width direction of the dielectric body 90.

With this configuration, the capacitive coupling of the first and second ground conductors with respect to the signal conductor is decreased. Accordingly, the width of the signal conductor is increased and transmission loss is decreased. If the width of the signal conductor is not changed, the interval between the signal conductor and the first and second ground conductors in the thickness direction of the dielectric body 90 is decreased, and the thickness of the high-frequency signal transmission line 10C is decreased.

Next, the positional relationship between the signal conductor 321 and the first and second ground conductors 4121 and 4221 in the curved portion 21C will be described more detail.

Figure 7B:
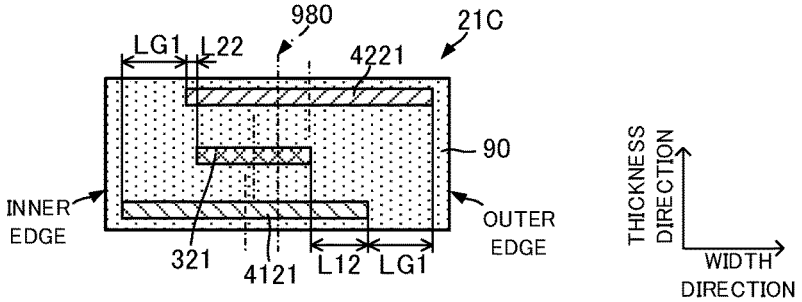
Figure 7C:
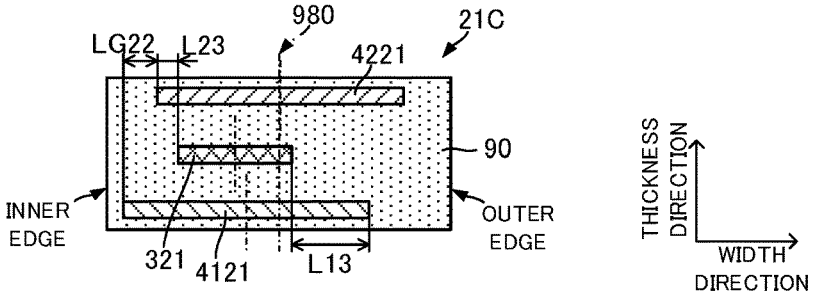
Figure 7D:
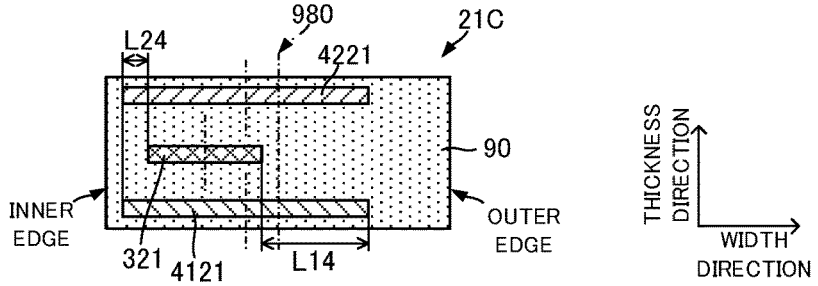

As illustrated in FIGS. 7B, 7C, and 7D, in the curved portion 21C, the position of the signal conductor 321 gradually shifts toward the inner edge of the curved portion 21C from the end portions in the extending direction (the end portions respectively connected to the straight portions 11C and 12C) toward the center in the extending direction.

Due to such shift of the signal conductor 321, in the regions close to the straight portions 11C and 12C of the curved portion 21C, the signal conductor 321 faces the first and second ground conductors 4121 and 4221 but the length of the portion on the inner edge side where the second ground conductor 4221 does not face the signal conductor 321 gradually decreases, as indicated by L22 in FIG. 7B. On the other hand, as indicated by L12 in FIG. 7B, the length of the portion on the outer edge side where the first ground conductor 4121 does not face the signal conductor 321 gradually increases. In this way, in the regions close to the straight portions 11C and 12C of the curved portion 21C, the length of the portion where the signal conductor 321 and the second ground conductor 4221 do not face each other on the inner edge side in the width direction of the signal conductor 321 is short, whereas the length of the portion where the signal conductor 321 and the first ground conductor 4121 do not face each other on the outer edge side in the width direction of the signal conductor 321 is long. Thus, the total amount of capacitive coupling in a transmission line having a strip line structure hardly changes, and also the characteristic impedance hardly changes.

As illustrated in FIG. 7C, the signal conductor 321 further shifts, that is, the end portion on the inner edge side of the signal conductor 321 and the end portion on the inner edge side of the second ground conductor 4221 are close to each other with a certain distance therebetween in the width direction of the dielectric body 90. In accordance with the amount of shift of the signal conductor 321, the second ground conductor 4221 also shifts toward the inner edge. Specifically, when the center position in the width direction of the signal conductor 321 is on the inner edge side relative to the center position in the width direction of the first ground conductor 4121, the second ground conductor 4221 also shifts toward the inner edge. In this state, the length of the portion on the inner edge side where the signal conductor 321 does not face the second ground conductor 4221 is represented by L23 in FIG. 7C, which is larger than L22 in FIG. 7B (L23>L22). That is, the amount of shift of the position of the second ground conductor 4221 is larger than the amount of shift of the position of the signal conductor 321. Accordingly, the length of the portion on the inner edge side where the signal conductor 321 does not face the first ground conductor 4121 decreases (the length corresponding to L23+LG22 (the length of the portion on the inner edge side where the first and second ground conductors 4121 and 4221 do not face each other) in FIG. 7C), and thus a decrease in the capacitive coupling between the signal conductor 321 and the first ground conductor 4121 is able to be compensated for by an increase in the capacitive coupling between the signal conductor 321 and the second ground conductor 4221. Thus, the total amount of capacitive coupling in a transmission line having a strip line structure hardly changes, and also the characteristic impedance hardly changes.

As illustrated in FIG. 7D, at the center position in the extending direction of the curved portion 21C, the signal conductor 321 further shifts, that is, the end portion on the inner edge side of the signal conductor 321 and the end portion on the inner edge side of the first ground conductor 4121 are close to each other in the width direction of the dielectric body 90. In this case, the end portion on the inner edge side of the second ground conductor 4221 is at a position identical to the end portion on the inner edge side of the first ground conductor 4121 in the width direction of the dielectric body 90. In this state, the length of the portion on the inner edge side where the signal conductor 321 does not face the first and second ground conductors 4121 and 4221 is represented by L24 in FIG. 7D, which is larger than L23 in FIG. 7C (L24>L23). Preferably, L24 is equal to L21. Accordingly, a decrease in capacitive coupling between the signal conductor 321 and the first ground conductor 4121, resulting from a decreased length of the portion on the inner edge side where the signal conductor 321 does not face the first ground conductor 4121 (the length corresponding to L24 in FIG. 7D), is able to be compensated for by the capacitive coupling between the signal conductor 321 and the second ground conductor 4221. Thus, the total amount of capacitive coupling in a transmission line having a strip line structure hardly changes, and also the characteristic impedance hardly changes.

As described above, in the curved portion 21C having the configuration according to the fourth preferred embodiment, the positions of the signal conductor 321 and the second ground conductor 4221 in the width direction of the dielectric body 90 are different at individual positions in the extending direction of the curved portion 21C. Specifically, in a region where the center position in the width direction of the signal conductor 321 is on the outer edge side relative to the center position in the width direction of the first ground conductor 4121 or is at a position identical to the center position in the width direction of the first ground conductor 4121, only the signal conductor 321 shifts toward the inner edge. In a region where the center position in the width direction of the signal conductor 321 is on the inner edge side relative to the center position in the width direction of the first ground conductor 4121, the second ground conductor 4221 also shifts toward the inner edge. In this case, the amount of shift of the second ground conductor 4221 is larger than the amount of shift of the signal conductor 321. Accordingly, change in characteristic impedance between individual positions in the extending direction of the curved portion 21C is significantly reduced or prevented. Thus, the characteristic impedance in the curved portion 21C is able to be set to a desired value suitable for transmitting a high-frequency signal. Furthermore, the width of the signal conductor 321 is able to be increased, similarly to the straight portions 11C and 12C. Therefore, transmission loss in the curved portion 21C is significantly reduced or prevented.

As described above, with use of the configuration according to the fourth preferred embodiment, the high-frequency signal transmission line 10C having an excellent transmission characteristic is obtained. Furthermore, the high-frequency signal transmission line 10C having high reliability is obtained, similarly to the above-described high-frequency signal transmission line 10 according to the first preferred embodiment.

In the fourth preferred embodiment, the second ground conductor 4221 gradually shifts toward the inner edge in the curved portion 21C. Alternatively, a configuration in which the second ground conductor 4221 gradually extends toward the inner edge may be used. Also, in the width direction of the dielectric body 90, the position on the inner edge side of the second ground conductor 4221 may be gradually shifted toward the inner edge without changing the position on the outer edge side of the second ground conductor 4221.

Figure 8A:
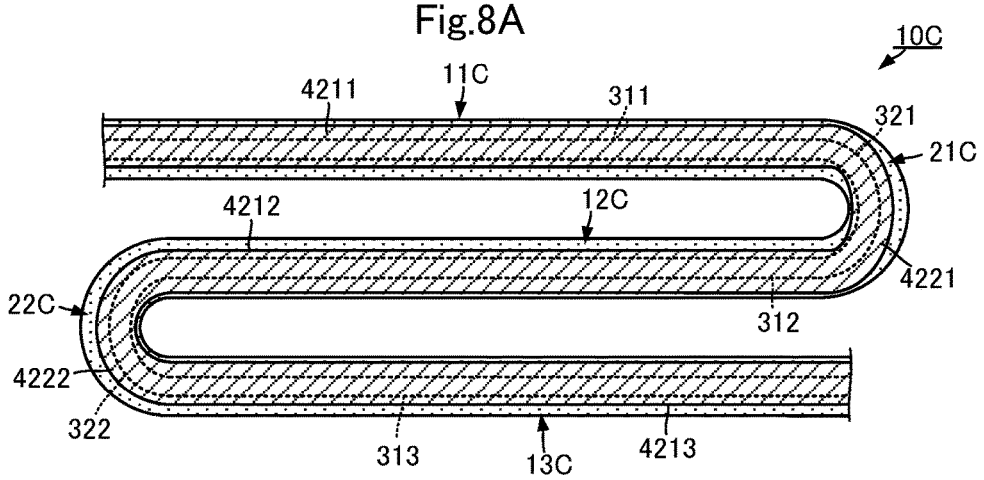
FIGS. 8A to 8C are plan views illustrating the configurations of the conductors in the high-frequency signal transmission line according to the fourth preferred embodiment of the present invention.
Figure 8B:
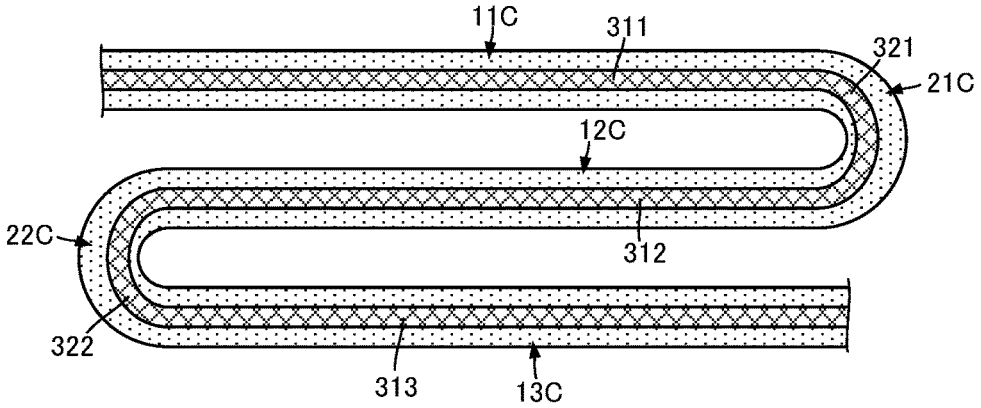
Figure 8C:
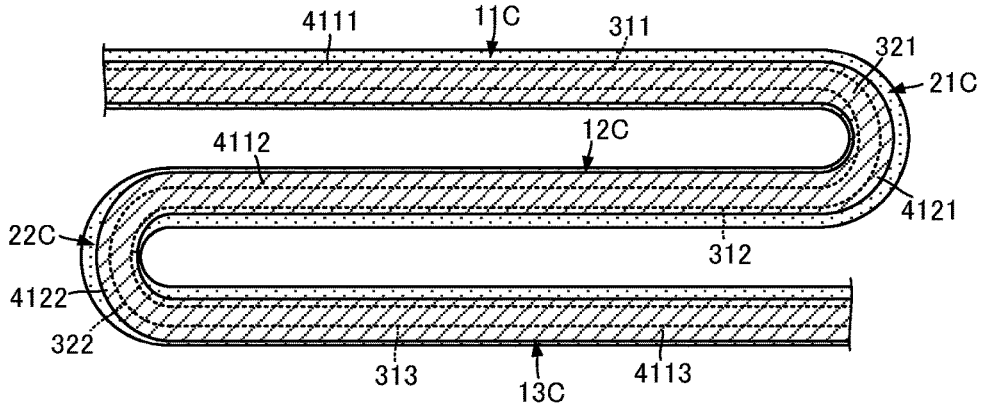

The description given above is of the case where there is one curved portion. In the case of using a high-frequency signal transmission line including a plurality of curved portions and two or more turning portions (see FIG. 1), the following configuration may preferably be used. FIGS. 8A to 8C are plan views illustrating the configurations of conductors of the high-frequency signal transmission line 10C according to the fourth preferred embodiment. FIG. 8A is a plan view illustrating the configurations of second ground conductors, FIG. 8B is a plan view illustrating the configurations of signal conductors, and FIG. 8C is a plan view illustrating the configurations of first ground conductors.

As illustrated in FIG. 8B, the signal conductor 312 is located at the center position in the width direction of the dielectric body 90 at any position in the extending direction of the straight portion 12C.

As illustrated in FIG. 8B, in a curved portion 22C, a signal conductor 322 is offset toward the inner edge of the curved portion 22C from the center position in the width direction of the curved portion 22C in the dielectric body 90, similarly to the signal conductor 321 in the curved portion 21C. The signal conductor 322 is the closest to the inner edge at the center in the extending direction of the curved portion 22C.

As illustrated in FIG. 8B, a signal conductor 313 is located at the center position in the width direction of the dielectric body 90 at any position in the extending direction of a straight portion 13C.

As illustrated in FIG. 8A, in the straight portion 12C, the second ground conductor 4212 faces substantially the entire principle surface of the signal conductor 312. One end in the width direction of the second ground conductor 4212 is close to one side surface of the dielectric body 90 (the side surface facing the straight portion 13C (the surface connected to the side surface at the outer edge of the curved portion 21C and the side surface at the inner edge of the curved portion 22C)). The other end in the width direction of the second ground conductor 4212 is located at a certain distance from the other side surface of the dielectric body 90 (the surface facing the straight portion 11C (the surface connected to the side surface at the inner edge of the curved portion 21C and the side surface at the outer edge of the curved portion 22C)).

As illustrated in FIG. 8A, in the curved portion 22C, a second ground conductor 4222 has a configuration similar to that of the first ground conductor 4121 in the curved portion 21C. Specifically, the second ground conductor 4222 faces substantially the entire principle surface of the signal conductor 322. The end portion on the inner edge side of the curved portion 22C in the width direction of the second ground conductor 4222 is close to the inner edge of the curved portion 22C. The end portion on the outer edge side in the width direction of the second ground conductor 4222 is spaced apart from the outer edge of the curved portion 22C.

As illustrated in FIG. 8A, in the straight portion 13C, a second ground conductor 4213 faces substantially the entire principle surface of the signal conductor 313. One end in the width direction of the second ground conductor 4213 is close to one side surface of the dielectric body 90 (the side surface facing the straight portion 12C (the surface connected to the side surface at the inner edge of the curved portion 22C)). The other end in the width direction of the second ground conductor 4213 is located at a certain distance from the other side surface of the dielectric body 90 (the side surface opposite to the side surface facing the straight portion 12C (the surface connected to the side surface at the outer edge of the curved portion 22C)).

As illustrated in FIG. 8C, in the straight portion 12C, the first ground conductor 4112 faces substantially the entire principle surface of the signal conductor 312. One end in the width direction of the first ground conductor 4112 is located at a certain distance from one side surface of the dielectric body 90 (the side surface facing the straight portion 13C (the surface connected to the side surface at the inner edge of the curved portion 22C)). The other end in the width direction of the first ground conductor 4112 is close to the other side surface of the dielectric body 90 (the side surface facing the straight portion 11C (the surface connected to the side surface at the outer edge of the curved portion 22C)).

As illustrated in FIG. 8C, in the curved portion 22C, a first ground conductor 4122 has a configuration similar to that of the second ground conductor 4221 in the curved portion 21C. Specifically, the first ground conductor 4122 faces substantially the entire principle surface of the signal conductor 322. The first ground conductor 4122 is offset toward the inner edge of the curved portion 22C from the center position in the width direction of the curved portion 22C in the dielectric body 90. The first ground conductor 4122 is the closest to the inner edge at the center in the extending direction of the curved portion 22C.

As illustrated in FIG. 8C, in the straight portion 13C, a first ground conductor 4113 faces substantially the entire principle surface of the signal conductor 313. One end in the width direction of the first ground conductor 4113 is located at a certain distance from one side surface of the dielectric body 90 (the side surface facing the straight portion 12C (the surface connected to the side surface at the inner edge of the curved portion 22C)). The other end in the width direction of the first ground conductor 4113 is close to the other side surface of the dielectric body 90 (the side surface opposite to the side surface facing the straight portion 12C (the surface connected to the side surface at the outer edge of the curved portion 22C)).

As described above, in the configuration according to the fourth preferred embodiment, the configurations of the first and second ground conductors in the curved portion 22C are opposite to those in the curved portion 21C. In other words, when the high-frequency signal transmission line 10C is viewed in plan, the configuration of the first ground conductor in the curved portion 21C is the same as the configuration of the second ground conductor in the curved portion 22C, and the configuration of the second ground conductor in the curved portion 21C is the same as the configuration of the first ground conductor in the curved portion 22C.

With this configuration, even if there are a plurality of curved portions curving in different directions, the capacitive coupling of the first and second ground conductors with respect to the signal conductor is decreased without the need to provide complex wiring of conductors. Accordingly, the width of the signal conductor is increased and transmission loss is decreased.

Figure 9A:
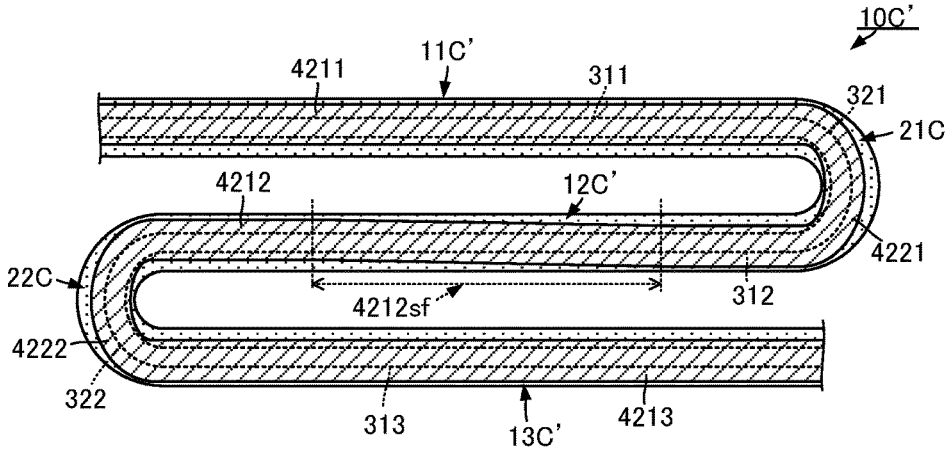
FIGS. 9A to 9C are plan views illustrating the configurations of the conductors in the high-frequency signal transmission line according to the fourth preferred embodiment of the present invention.
Figure 9B:
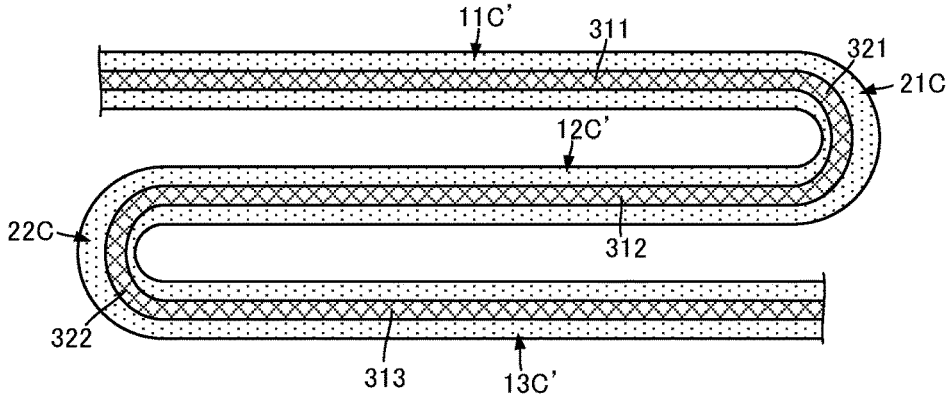
Figure 9C:
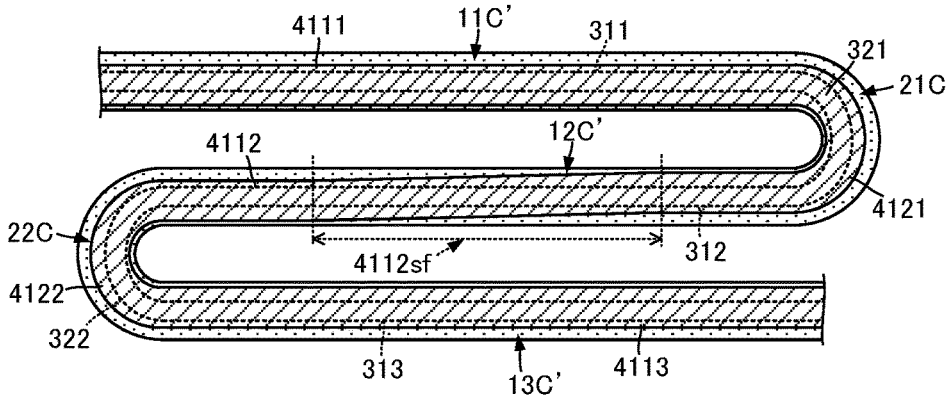

In the case of using a high-frequency signal transmission line including a plurality of curved portions and two or more turning portions (see FIG. 1), a straight portion whose both ends in the extending direction are connected to curved portions may have the following configuration. FIGS. 9A to 9C are plan views illustrating the configurations of conductors of a high-frequency signal transmission line 10C' according to the fourth preferred embodiment of the present invention. FIG. 9A is a plan view illustrating the configurations of second ground conductors, FIG. 9B is a plan view illustrating the configurations of signal conductors, and FIG. 9C is a plan view illustrating the configurations of first ground conductors.

As illustrated in FIG. 9B, in a straight portion 12C', the signal conductor 312 is located at the center position in the width direction of the dielectric body 90 at any position in the extending direction of the straight portion 12C'.

As illustrated in FIG. 9A, in the straight portion 12C', the portion on the curved portion 21C side of the second ground conductor 4212 shifts toward one side surface (on the straight portion 13C' side) of the dielectric body 90, as in the configuration described above. On the other hand, the portion on the curved portion 22C side of the second ground conductor 4212 shifts toward the other side surface (on the straight portion 11C' side) of the dielectric body 90. Thus, the second ground conductor 4212 includes a position shift portion 4212*sf*. At the position shift portion 4212*sf*, the amount and direction of shift of the second ground conductor 4212 from the center position in the width direction gradually change in the extending direction of the straight portion 12C'.

As illustrated in FIG. 9C, in the straight portion 12C', the portion on the curved portion 21C side of the first ground conductor 4112 shifts toward the other side surface (on the straight portion 11C' side) of the dielectric body 90, as in the configuration described above. On the other hand, the portion on the curved portion 22C side of the first ground conductor 4112 shifts toward the one side surface (on the straight portion 13C' side) of the dielectric body 90. Thus, the first ground conductor 4112 includes a position shift portion 4112*sf*. At the position shift portion 4112*sf*, the amount and direction of shift of the first ground conductor 4112 from the center position in the width direction gradually change in the extending direction of the straight portion 12C'.

The position shift portion 4112*sf* of the first ground conductor 4112 and the position shift portion 4212*sf* of the second ground conductor 4212 overlap each other. At individual positions in the extending direction of the straight portion 12C', the amount of shift of the position shift portion 4112*sf* of the first ground conductor 4112 is the same as the amount of shift of the position shift portion 4212*sf* of the second ground conductor 4212. At individual positions in the extending direction of the straight portion 12C', the direction of shift of the position shift portion 4112*sf* of the first ground conductor 4112 is opposite (reverse) to the direction of shift of the position shift portion 4212*sf* of the second ground conductor 4212.

With this configuration, change in characteristic impedance between positions in the extending direction is significantly reduced or prevented in the straight portion whose both ends are connected to curved portions, without using a complex configuration. Accordingly, a decrease in transmission loss is significantly reduced or prevented.

Figure 10A:
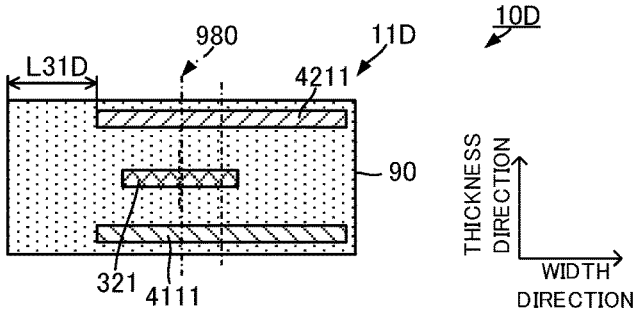
FIGS. 10A to 10D are cross-sectional views illustrating the configurations of conductors in a high-frequency signal transmission line according to a fifth preferred embodiment of the present invention.
Figure 10B:
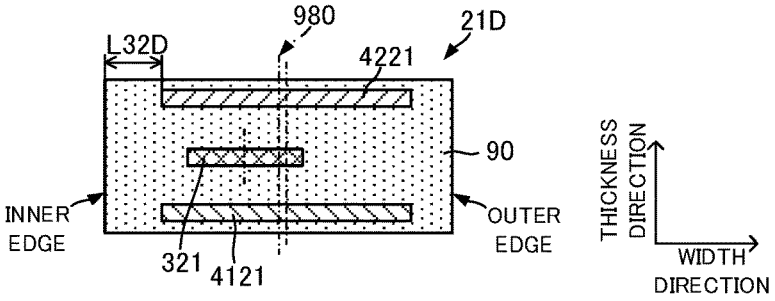
Figure 10C:
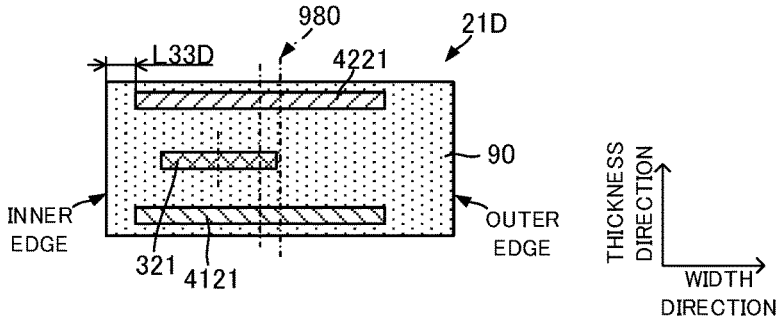
Figure 10D:
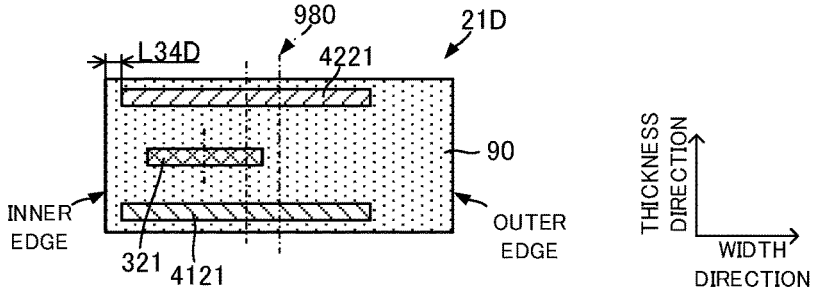

Next, a high-frequency signal transmission line according to a fifth preferred embodiment will be described with reference to the drawings. FIGS. 10A to 10D are cross-sectional views illustrating the configurations of conductors in a high-frequency signal transmission line 10D according to the fifth preferred embodiment of the present invention. FIG. 10A is a cross-sectional view of a portion corresponding to the same position as the cross section taken along line A-A' in FIGS. 6A to 6C, FIG. 10B is a cross-sectional view of a portion corresponding to the same position as the cross section taken along line C-C' in FIGS. 6A to 6C, FIG. 10C is a cross-sectional view of a portion corresponding to the same position as the cross section taken along line D-D' in FIGS. 6A to 6C, and FIG. 10D is a cross-sectional view of a portion corresponding to the same position as the cross section taken along line B-B' in FIGS. 6A to 6C.

The high-frequency signal transmission line 10D according to the fifth preferred embodiment includes the same elements as those of the high-frequency signal transmission line 10 according to the first preferred embodiment, but has a different positional relationship between the signal conductor and the first and second ground conductors.

In the high-frequency signal transmission line 10D, the positional relationship between the signal conductor and the first and second ground conductors is the same in a straight portion 11D and a curved portion 21D. In the high-frequency signal transmission line 10D, the position of a conductor group, including the signal conductor and the first and second ground conductors, in the width direction of the dielectric body 90 is different in the straight portion 11D and at individual positions in the extending direction of the curved portion 21D.

Specifically, in the straight portion 11D, the first ground conductor 4111 and the second ground conductor 4211 have the same width. The first ground conductor 4111 and the second ground conductor 4211 are at the same position in the width direction.

One ends in the width direction of the first and second ground conductors 4111 and 4211 are close to one side surface (the side surface connected to the side surface at the outer edge of the curved portion 21D) of the dielectric body 90. The other ends in the width direction of the first and second ground conductors 4111 and 4211 are at a certain distance from the other side surface (the side surface connected to the side surface at the inner edge of the curved portion 21D) of the dielectric body 90.

The other end in the width direction of the signal conductor 321 is close to the other ends in the width direction of the first and second ground conductors 4111 and 4211. That is, the center position in the width direction of the signal conductor 321 is offset toward the other side surface of the dielectric body 90 from the center positions in the width direction of the first and second ground conductors 4111 and 4211.

In the curved portion 21D, the position of the conductor group including the signal conductor 321 and the first and second ground conductors 4121 and 4221 gradually changes toward the inner edge of the curved portion 21D in accordance with change in the position in the extending direction of the curved portion 21D. The conductor group including the signal conductor 321 and the first and second ground conductors 4121 and 4221 is the closest to the inner edge of the curved portion 21D at the center position in the extending direction of the curved portion 21D.

Specifically, at the position corresponding to the cross section taken along line C-C' in the curved portion 21D, the positional relationship of the first and second ground conductors 4121 and 4221 relative to the signal conductor 321 is the same. At the position corresponding to the cross section taken along line C-C' in the curved portion 21D, the conductor group including the signal conductor 321 and the first and second ground conductors 4121 and 4221 is closer to the other side surface (the side surface at the inner edge) of the dielectric body 90 than in the straight portion 11D. That is, a distance L32D between the other ends in the width direction of the first and second ground conductors 4121 and 4221 and the other side surface of the dielectric body 90 at the position corresponding to the cross section taken along line C-C' in the curved portion 21D is shorter than a distance L31D between the other ends in the width direction of the first and second ground conductors 4111 and 4211 and the other side surface of the dielectric body 90 in the straight portion 11D (L32D<L31D).

At the position corresponding to the cross section taken along line D-D' in the curved portion 21D, the conductor group including the signal conductor 321 and the first and second ground conductors 4121 and 4221 is closer to the side surface at the inner edge of the curved portion 21D than at the position corresponding to the cross section taken along line C-C' in the curved portion 21D. That is, a distance L33D between the other ends in the width direction of the first and second ground conductors 4121 and 4221 and the other side surface of the dielectric body 90 at the position corresponding to the cross section taken along line D-D' in the curved portion 21D is shorter than the distance L32D between the other ends in the width direction of the first and second ground conductors 4121 and 4221 and the other side surface of the dielectric body 90 at the position corresponding to the cross section taken along line C-C' in the curved portion 21D (L33D<L32D).

At the position corresponding to the cross section taken along line B-B' in the curved portion 21D, corresponding to the center position in the extending direction of the curved position 21D, the conductor group including the signal conductor 321 and the first and second ground conductors 4121 and 4221 is closer to the side surface at the inner edge of the curved portion 21D than at the position corresponding to the cross section taken along line D-D' in the curved portion 21D. That is, a distance L34D between the other ends in the width direction of the first and second ground conductors 4121 and 4221 and the other side surface of the dielectric body 90 at the position corresponding to the cross section taken along line B-B' in the curved portion 21D is shorter than the distance L33D between the other ends in the width direction of the first and second ground conductors 4121 and 4221 and the other side surface of the dielectric body 90 at the position corresponding to the cross section taken along line D-D' in the curved portion 21D (L34D<L33D).

With this configuration, advantageous effects similar to those in the above-described fourth preferred embodiment are obtained.

Figure 11A:
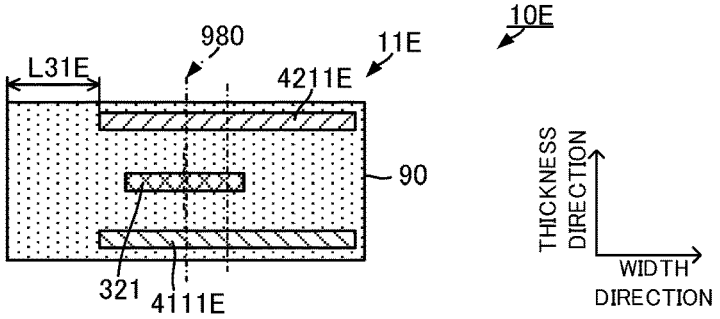
FIGS. 11A to 11D are cross-sectional views illustrating the configurations of conductors in a high-frequency signal transmission line according to a sixth preferred embodiment of the present invention.
Figure 11B:
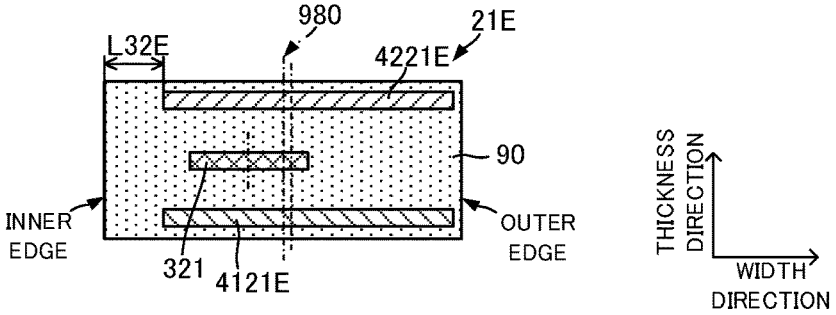
Figure 11C:
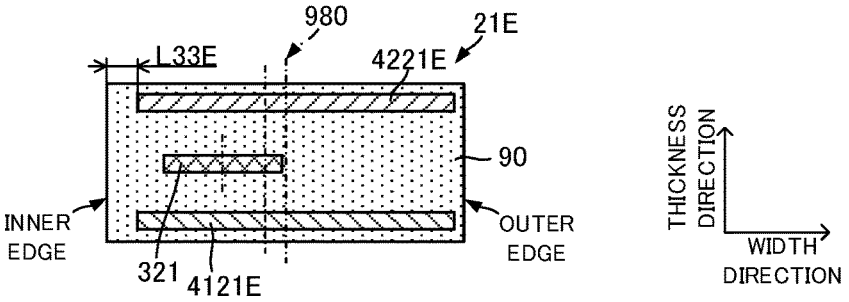
Figure 11D:
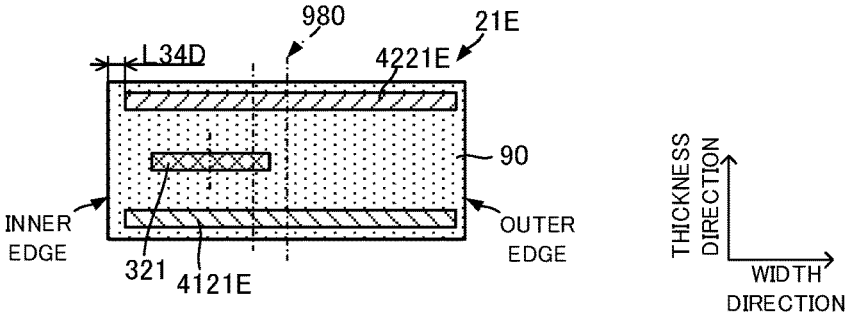

Next, a high-frequency signal transmission line according to a sixth preferred embodiment will be described with reference to the drawings. FIGS. 11A to 11D are cross-sectional views illustrating the configurations of conductors in a high-frequency signal transmission line 10E according to the sixth preferred embodiment of the present invention. FIG. 11A is a cross-sectional view of a portion corresponding to the same position as the cross section taken along line A-A' in FIGS. 6A to 6C, FIG. 11B is a cross-sectional view of a portion corresponding to the same position as the cross section taken along line C-C' in FIGS. 6A to 6C, FIG. 11C is a cross-sectional view of a portion corresponding to the same position as the cross section taken along line D-D' in FIGS. 6A to 6C, and FIG. 11D is a cross-sectional view of a portion corresponding to the same position as the cross section taken along line B-B' in FIGS. 6A to 6C.

The high-frequency signal transmission line 10E according to the sixth preferred embodiment is different from the high-frequency signal transmission line 10D according to the fifth preferred embodiment in the configurations of the first and second ground conductors. The configuration of the other portions is the same as that of the high-frequency signal transmission line 10D according to the fifth preferred embodiment.

First and second ground conductors 4111E and 4211E in a straight portion 11E in the high-frequency signal transmission line 10E are the same as the first and second ground conductors 4111 and 4211 in the straight portion 11D in the high-frequency signal transmission line 10D according to the fifth preferred embodiment.

In first and second ground conductors 4121E and 4221E in a curved portion 21E in the high-frequency signal transmission line 10E, the positions of the end portions on the inner edge side vary at individual positions in the extending direction of the curved portion 21E. On the other hand, in the first and second ground conductors 4121E and 4221E, the positions of the end portions on the outer edge side do not vary at individual positions in the extending direction of the curved portion 21E. That is, the lengths of the first and second ground conductors 4121E and 4221E vary at the individual positions in the extending direction of the curved portion 21E. In other words, the widths of the first and second ground conductors 4121E and 4221E increase in the direction toward the center position in the extending direction of the curved portion 21E.

In such a configuration, the portions of the first and second ground conductors different from the region where capacitive coupling to the signal conductor occurs extend. Thus, the characteristic impedance hardly changes at individual positions in the extending direction of the curved portion 21E, and the same advantageous effects as those of the high-frequency signal transmission lines according to the fourth and fifth preferred embodiments are obtained.

Figure 12A:
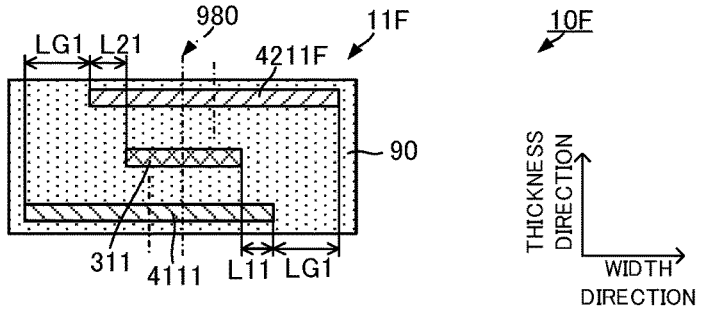
FIGS. 12A to 12D are cross-sectional views illustrating the configurations of conductors in a high-frequency signal transmission line according to a seventh preferred embodiment of the present invention.
Figure 12B:
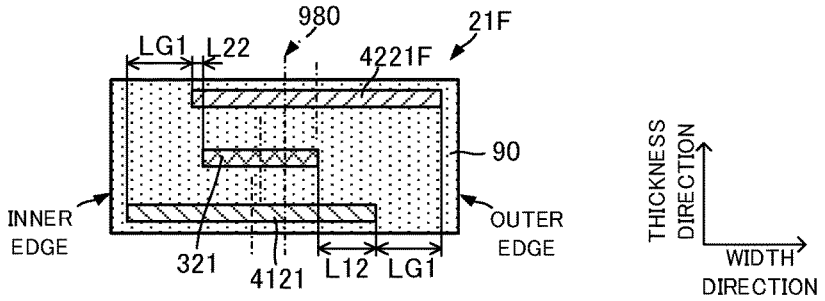
Figure 12C:
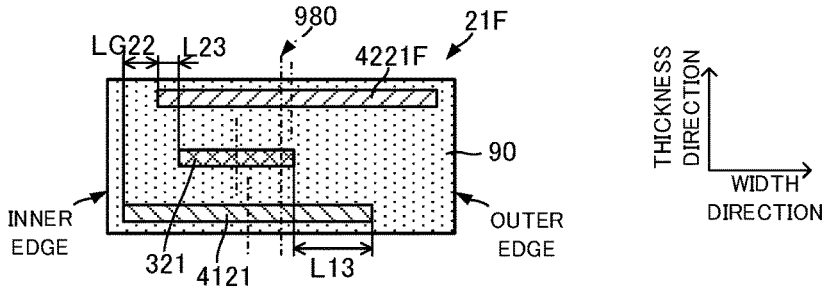
Figure 12D:
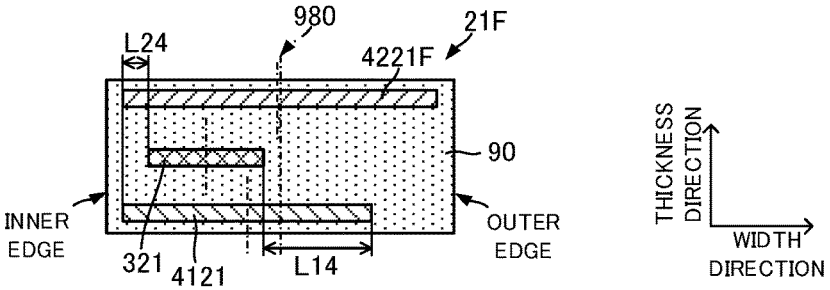

Next, a high-frequency signal transmission line according to a seventh preferred embodiment will be described with reference to the drawings. FIGS. 12A to 12D are cross-sectional views illustrating the configurations of conductors in a high-frequency signal transmission line 10F according to the seventh preferred embodiment of the present invention. FIG. 12A is a cross-sectional view of a portion corresponding to the same position as the cross section taken along line A-A' in FIGS. 6A to 6C, FIG. 12B is a cross-sectional view of a portion corresponding to the same position as the cross section taken along line C-C' in FIGS. 6A to 6C, FIG. 12C is a cross-sectional view of a portion corresponding to the same position as the cross section taken along line D-D' in FIGS. 6A to 6C, and FIG. 12D is a cross-sectional view of a portion corresponding to the same position as the cross section taken along line B-B' in FIGS. 6A to 6C.

The high-frequency signal transmission line 10F according to the seventh preferred embodiment is different from the high-frequency signal transmission line 10 according to the first preferred embodiment in the configuration of a second ground conductor 4221F in a curved portion 21F. The configuration of the other portions, including a straight portion 11F, is the same as that of the high-frequency signal transmission line 10 according to the first preferred embodiment.

The second ground conductor 4221F according to the seventh preferred embodiment has a width (the length in the width direction) that varies at individual positions in the extending direction of the curved portion 21F. Specifically, the width of the second ground conductor 4221F increases in the direction toward the center position in the extending direction of the curved portion 21F in accordance with shift of the position along the width direction of the signal conductor 321.

With this configuration, advantageous effects similar to those in the first preferred embodiment are obtained. Furthermore, since the area of the second ground conductor 4221F in the curved portion 21F increases, external radiation of a high-frequency signal and superposition of external noise on a high-frequency signal are further significantly reduced or prevented.

In the above-described fourth to seventh preferred embodiments, the signal conductor preferably is located between the first ground conductor and the second ground conductor along the thickness direction of the dielectric body 90, and the entire surface of the signal conductor faces both of the first ground conductor and the second ground conductor. However, the signal conductor may have a portion that does not face at least one of the first ground conductor and the second ground conductor in accordance with an allowable range of characteristic impedance based on an allowable range of transmission loss. Preferably, however, substantially the entire surface of the signal conductor faces the first ground conductor and the second ground conductor, as in the above-described configurations.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency signal transmission line comprising:

a dielectric body that extends along a high-frequency signal transmission direction;

a signal conductor that is in the dielectric body and that extends along the high-frequency signal transmission direction; and a ground conductor that is in the dielectric body and that is electromagnetically coupled to the signal conductor; wherein the dielectric body includes, along the high-frequency signal transmission direction, a plurality of straight portions and a curved portion connecting the plurality of straight portions;

in the curved portion, the signal conductor is located at a position on an inner side of a curve relative to a center position in a width direction of the dielectric body; and in the plurality of straight portions, the signal conductor is located at or substantially at a center position in the width direction of the dielectric body.

2. The high-frequency signal transmission line according to claim 1, wherein the signal conductor has a larger width in the curved portion than in the plurality of straight portions.

3. The high-frequency signal transmission line according to claim 1, wherein the plurality of straight portions extend parallel or substantially parallel to each other.

4. The high-frequency signal transmission line according to claim 1, wherein the curved portion includes at least two curved portions, and the plurality of straight portions and the at least two curved portions are integral with each other.

5. The high-frequency signal transmission line according to claim 1, wherein the dielectric body includes a strip line defined by the signal conductor and the ground conductor.

6. The high-frequency signal transmission line according to claim 1, wherein the curved portion is curved by 180 degrees and has a flat film shape.

7. The high-frequency signal transmission line according to claim 1, wherein the curved portion includes a plurality of curved portions and the signal conductor includes a plurality of signal conductors that are offset toward inner edges of the plurality of curved portions.

8. The high-frequency signal transmission line according to claim 1, wherein the signal conductor includes a plurality of signal conductors with different widths.

9. The high-frequency signal transmission line according to claim 1, wherein an angle defined by an extending direction of one of the plurality of straight portions and an extending direction of the another one of the plurality of straight portions is about 90 degrees.

10. The high-frequency signal transmission line according to claim 1, wherein the high-frequency signal transmission line has one of a strip-line structure and a micro-strip-line structure.

11. The high-frequency signal transmission line according to claim 1, wherein each of the plurality of straight portions include a first ground conductor and a second ground conductor shifted in opposite directions in the width direction of the dielectric body.

12. The high-frequency signal transmission line according to claim 1, wherein the ground conductor includes a first ground conductor and a second ground conductor; and the signal conductor is located between the first ground conductor and the second ground conductor along a thickness direction of the dielectric body.

13. The high-frequency signal transmission line according to claim 12, wherein in the plurality of straight portions of the dielectric body, at least one of a center position in a width direction of the first ground conductor and a center position in a width direction of the second ground conductor is different from a center position in a width direction of the signal conductor in the width direction of the dielectric body.

14. The high-frequency signal transmission line according to claim 13, wherein in the curved portion of the dielectric body:

at an end portion connected to the plurality of straight portions, the center position in the width direction of the first ground conductor is at a position on the inner side of the curve relative to the center position in the width direction of the signal conductor and the center position in the width direction of the second ground conductor; and the center position in the width direction of the signal conductor and the center position in the width direction of the second ground conductor shift toward the inner side of the curve, in a direction toward a center position in an extending direction of the curved portion.

15. The high-frequency signal transmission line according to claim 14, wherein in the curved portion:

in a region where the center position in the width direction of the signal conductor is on an outer side of the curve relative to the center position in the width direction of the first ground conductor or is at a position identical to the center position in the width direction of the first ground conductor, the center position in the width direction of the second ground conductor does not shift whereas the center position in the width direction of the signal conductor shifts toward the inner side of the curve, in the direction toward the center position in the extending direction of the curved portion; and in a region where the center position in the width direction of the signal conductor is on the inner side of the curve relative to the center position in the width direction of the first ground conductor, the center position in the width direction of the second ground conductor shifts toward the inner side of the curve with a shift amount larger than a shift amount of the center position in the width direction of the signal conductor.

16. The high-frequency signal transmission line according to claim 1, wherein the curved portion is curved by 90 degrees when viewed in plan.

17. The high-frequency signal transmission line according to claim 16, wherein the curved portion includes the signal conductor.

18. The high-frequency signal transmission line according to claim 17, wherein the signal conductor is offset toward an inner edge of the curved portion from the center position in the width direction of the curved portion in the dielectric body.

19. The high-frequency signal transmission line according to claim 17, wherein the signal conductor has an arc shape with a radius of curvature larger than that of the curved portion when viewed in plan.

* * * * *